United States Patent [19]

Groswith, III et al.

[11] Patent Number: 4,887,925

[45] Date of Patent: Dec. 19, 1989

[54] PRONG AND TANG BINDING SYSTEM

[75] Inventors: Charles T. Groswith, III, Los Altos; Edwin A. Seipp, III, Menlo Park, both of Calif.

[73] Assignee: Taurus Holdings, Inc., Mountain View, Calif.

[21] Appl. No.: 237,016

[22] Filed: Aug. 26, 1988

[51] Int. Cl.[4] ..... B42F 13/08

[52] U.S. Cl. ..... 402/15; 281/21.1; 281/15.1; 402/68; 412/43

[58] Field of Search ..... 281/15 R, 21 R, 25, 281/29, 31, 30, 21.1, 15.1; 402/68, 80 R, 15, 22; 412/43

[56] References Cited

U.S. PATENT DOCUMENTS

| | | | |
|---|---|---|---|
| 277,456 | 5/1883 | Cagney | 281/27.3 |
| 1,250,204 | 12/1917 | Morehouse | 281/27.3 |
| 1,293,807 | 2/1919 | Krohmer | 281/27.3 |
| 1,841,989 | 1/1932 | Smith | 281/27.3 |
| 3,485,564 | 12/1969 | Holes et al. | 402/13 |
| 3,645,637 | 2/1972 | Gustafson | 402/15 |
| 3,730,560 | 5/1973 | Abildgaard et al. | 281/21 R |
| 3,736,200 | 5/1973 | Abilgaard et al. | 156/85 |
| 3,834,739 | 9/1977 | Abildgaard et al. | 281/21 R |
| 4,072,326 | 2/1978 | Groswith, III et al. | 281/21 R |
| 4,139,216 | 2/1979 | Saint Clair | 281/25 A X |
| 4,548,426 | 10/1985 | Lockhart | 251/29 |
| 4,743,048 | 5/1988 | Groswith, III et al. | 281/21 R |

*Primary Examiner*—Paul A. Bell

*Attorney, Agent, or Firm*—Skjerven, Morrill, MacPherson, Franklin & Friel

[57] ABSTRACT

A prong or tang-type paper sheets binding system includes a cover marginal edge on which or over which the connector base and the prongs or tangs are abutted or bent with respect to the edge. An integral imperforate edge extension is provided which is foldable over the bent prongs and any keeper and foldable over the prong base or head to cover the exposed unattractive metal components of the connector including the prongs or tangs. In a preferred embodiment a second integral edge extension which contains a slot sized to encompass the bent prongs and a keeper if employed, or the prong base is foldable over the imperforate extension so that a planar smooth-finished surface of the imperforate extension covers the otherwise exposed metal components of the connector.

3 Claims, 3 Drawing Sheets

PRONG AND TANG BINDING SYSTEM

FIELD OF THE INVENTION

The present invention is directed to an improved prong-type and tang-type sheet retainers paper sheets binding system. More particularly, the invention is directed to a system in which a prong/tang binding system is made more permanent, secure and tamper-proof, less likely to open or cause injury and has a more finished bindery-like appearance.

BACKGROUND OF THE INVENTION

Two of the more popular office-type prior art sheet retainers used in binding a stack of punched-paper sheets together are the so-called ACCO prong and Duo-Tang tang binders shown in FIGS. 1A and 1B hereof. In the ACCO binder, FIG. 1A, a pair of prongs extending from a longitudinal base are inserted through spaced apertures from one side or top margin of a paper sheets stack. A keeper, sometimes called a compressor bar, with rectangular apertures is placed over the prongs from the opposite side of the stack so that the prongs pass through the apertures. The prongs are then bent 90° toward each other to rest in a longitudinal groove in the keeper and a pair of locking loops slidable along the groove then are positioned over the bent prongs to temporarily lock the prongs on the keeper. The paper stack is thus held temporarily at a margin by being pressed between the prong base and the keeper. The fastener is normally made of metal, is relatively thin and can become easily twisted, has edges which may cut a hand or which may scratch a fine surface on which it is laid. Further it extends above the paper sheets stack, can become disconnected inadvertently during use and does not have a pleasing appearance. In addition, since often 3-hole punched paper is held in such a binder by the prongs passing through only the first and third holes (leaving the center hole unsecured), present ACCO binders tend to bow in the middle when the covers are opened, exposing the center hole, likewise presenting an unpleasing appearance. In the Duo-Tang binder, FIG. 1B, usually three separate or interconnected pairs of tangs are inserted through a paper stack normally with an associated cover. The tangs normally are constructed as a pair of legs integrally extending from a grommet pre-clamped on a first margin portion of a paper sheets cover having a second cover margin spaced therefrom containing a second open grommet. The paper stack is placed between the two margins with the tang(s) bent 90° to the margin, passed through the paper sheets aperture(s) and the second grommet or aperture in the second separate or integral cover margin, and the tangs rebent 90° away from each other to rest against the second margin. As in the FIG. 1A device, the tangs are usually metal, can scratch or cut, can be inadvertently rebent outwardly or twisted, bound sheets may likely be easily pulled out and the binding has an unpleasing exposed look.

Broadly, others including a co-inventor of this invention have proposed binding systems which at least in part overlie or encapsulate a head of a fixed post and socket-type of paper sheets connector and which is aesthetically pleasing. These prior inventions are exemplified by U.S. Pat. Nos. 4,743,048; 4,072,326; 4,139,216; 3,834,739; and 3,730,560. To the knowledge of the inventors herewith means such as described herein have not been suggested to improve a prong-type or tang-type fastener binding of the ACCO or Duo-Tang type. U.S. Pat. No. 4,548,426 shows a three-piece binding cover in which portions of one piece overlie common staples used to assemble the binding.

SUMMARY OF THE INVENTION

The present invention provides a relatively permanent covered book, report or the like utilizing common prong-type or tang-type fasteners for binding a stack of punched hole paper sheets. A cover margin extension is provided which completely covers the prong/tang fastener(s) after initial assembly and results in an aesthetically pleasing binder with or without an integral spine portion. First integral imperforate marginal edge extensions are provided immediately next to the cover margin edges abutting the prong keeper or base, or tang grommets, and the cover through which the prongs are passed and then bent parallel therewith. A pressure sensitive adhesive layer is provided on these marginal edge extensions with a suitable protective release strip positioned thereon. After normal assembly of the ACCO-type or Duo-Tang type connector, the release strip is removed from the marginal edge extensions to expose the adhesive and the extensions each with its adhesive layer are folded over and pressed on the prong base and the bent prong and keeper, if any, or on the grommets and bent tang legs, respectively, to completely cover the connector parts.

In a preferred embodiment, first perforated marginal edge extensions each having at least one elongated rectangular perforation or through-hole is provided and sized to accommodate the prong base and bent prongs and keeper, if any, or the grommets and bent tang legs. The perforated marginal edge extensions are first folded over the imperforate marginal extensions and the folded extensions then folded on the margin edges to cover the exposed top portions of the prongs, keeper if any, and the prong base, or grommets and tangs. The result is a professional-looking bindery-type binding which can be done by office, student or other personnel following simple directions without special training or binding equipment. The imperforate extensions cover the entire marginal edge and the metal parts of the connector thus preventing the metal parts from cutting or scratching, from bending or twisting or from unlocking. Depending upon the type of pressure sensitive adhesive selected, the bound document can be either permanent (tamper-proof) or updateable (resealable).

DETAILED DESCRIPTION OF THE DRAWINGS

Figure 1A:
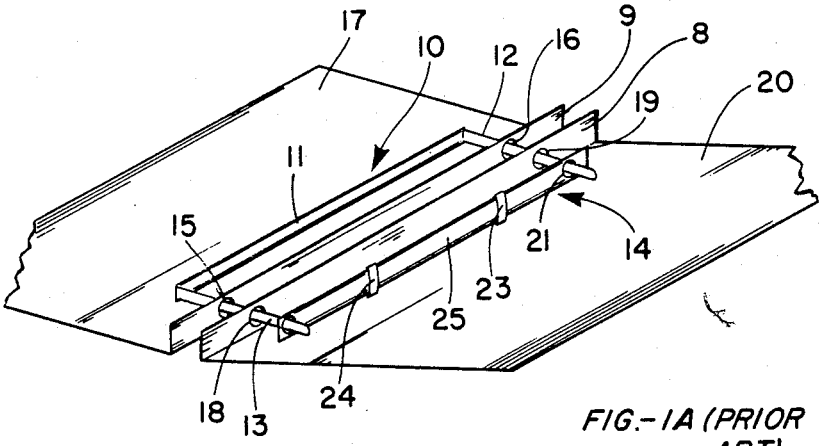
FIG.-1A (PRIOR ART)
FIG. 1A is a partial perspective view of a prior art ACCO prong fastener binding (less paper stack) with separate covers.

The prior art prong and tang bindings have been described generally above. The former is seen in FIG. 1A where a first fasteners member 10 having an elongated thin metal base 11 and two thin metal prongs 12, 13 which are bendable to extend generally perpendicular from the base 11 and which pass through spaced apertures 15, 16 in a marginal edge 9 of the cover 17 and through apertures 18, 19 in marginal edge 8 of a cover 20. A keeper 14 having spaced rectangular perforations 21, 22 for reception of the prongs 12, 13 is placed over the prongs and pressed against margin 8 to cinch sheets of punched hole paper (not shown) between the facing surfaces of marginal edges 8 and 9. The prongs also pass through such punch holes. The keeper 14 has a pair of locking loops 23, 24 slidable along a longitudinal groove 25 in the keeper. After the keeper is cinched with base 11 with the margins 8, 9 and paper stack therebetween, the prongs are bent 90° toward each other into groove 25 and locked in place by frictional movement and positioning of the locking loops over the bent prongs. As is apparent the completed binding will leave the keeper, the loops and bent prongs exposed and raised on the extension of marginal edge 8 and the prong base 11 exposed and raised on the exterior of marginal edge 9.

Figure 1B:
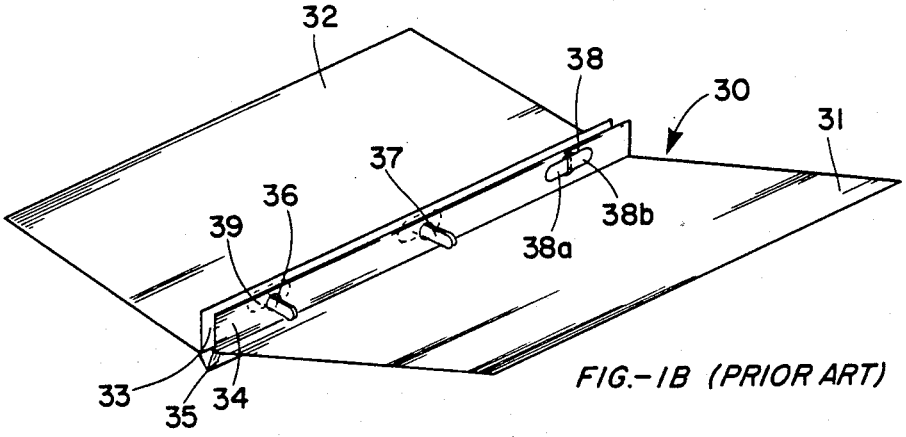
FIG.-1B (PRIOR ART)
FIG. 1B is a partial perspective view of a prior art Duo-Tang fastener binding (less paper stack) with integral covers.

In FIG. 1B a continuous integral cover 30 is provided comprising booklet front and back covers 31, 32 joined by integral double folds 33, 34 and a double fold spine section 35. A tang head 39 is permanently crimped in double-fold 33 and the double-tangs 36, 37, 38 passed through the paper stack apertures (not shown) between double-folds 33 and 34 and through aligned apertures in double-fold 34. The double tangs **38*a*, 38*b* for example are then bent outwardly to lie parallel to and abutting the exterior of double-fold 34 to hold the clamped sheets of paper stack together. The crimped tang head or base 39 and the bent prongs are left exposed on the exterior surfaces of double-folds 33 and 34 respectively when the covers 31, 32** are opened.

Figure 2:
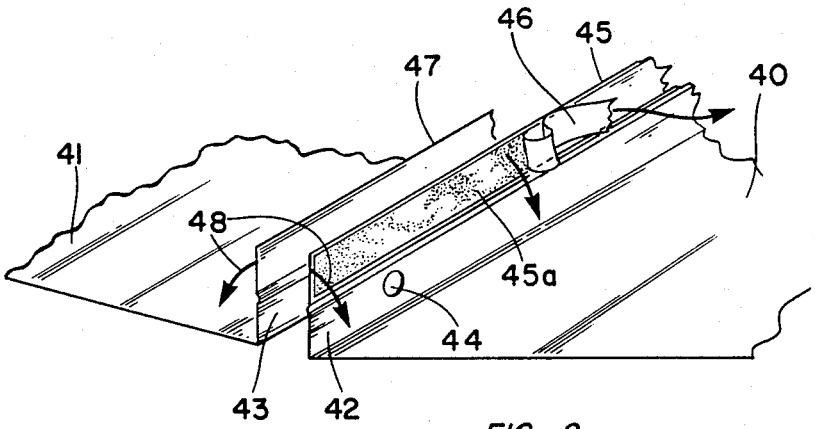
FIG. 2 is a partial schematic perspective view of a two-part cover binding of the invention prior to paper stack positioning and insertion of an ACCO prong fastener.
Figure 3:
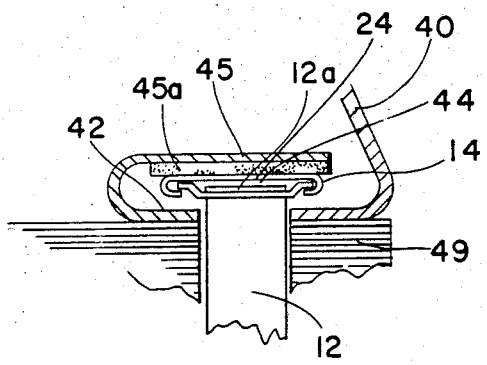
FIG. 3 is a partial cross-sectional view of the cover and a paper stack as assembled taken across a stack aperture perpendicular to the longitudinal axis of the keeper and prongs of an ACCO binder used in the FIG. 2 embodiment.

FIG. 2 shows a first embodiment of the invention in which separate covers 40 and 41 contain marginal edges 42 and 43, respectively with apertures 44 for passage of a connector prong(s). Once the prongs, tangs or other similar type connector(s) is passed through aligned apertures in margins 42 and 43 and through the punch holes of a paper stack, the prongs/tangs are bent to cinch the covers and stack of sheets together. Upon completion of the normal assembly, the protective release sheet 46 is stripped from the adhesive **45*a* bonded to imperforate margin extensions 45, 47 and the margins folded as indicated by arrows 48 against the exposed portions of the fasteners to effectively cover and seal thereagainst and the remainder of the exterior surface of margins 42, 43. A small bump is normally then present, depending upon the thickeners and resiliency of the adhesive layer, since the prongs or keeper will normally slightly impress an outline on the folded imperforate extension. This bump can be eliminated by using an adhesive strip approximately the same thickness as the metal components with cutouts in said adhesive strip into which said metal components nest. FIG. 3 clearly shows the folded margin 45 adhesively bonded to the top of the keeper 14 and locking loop 24 and a bent prong 12*a*. This view also shows a portion of a paper stack 49** which is bound by the ACCO-type binding.

Figure 4:
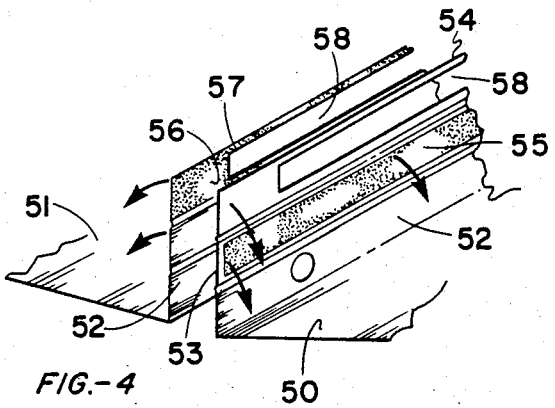
FIG. 4 is a partial schematic perspective view of a preferred embodiment of a two-part cover binding.

FIG. 4 shows a preferred embodiment of the invention where discrete covers 50, 51 each having an integral apertured margin 21 edge 52, an integral imperforate marginal edge extension 53 and an integral perforated marginal edge extension 54. The latter extension 54 contains an elongated longitudinal slot 58 dimensioned to accommodate the keeper, interlocking loops and bent prongs or the prong base of an ACCO-type or other fastener. The extension 54 has an adhesive 56 thereon for bonding to margins 52 when the extension 54 is folded thereagainst with the slot 58 surrounding and encompassing the operative parts of the fastened connector parts extending outwardly from the exterior surface of marginal edges 52. An adhesive layer 55 is also present on the imperforate edge extension 53 to bond the extension 53 to the extension 54 and to the connector parts which overlie the outer surface of marginal edge 52 and which extend above that marginal edge. A peel-off release strip is provided over both adhesive layers 55, 56 which strip is removed prior to folding extension 54 on extension 53 and the resultant double-fold on marginal edge 52.

Figure 5:
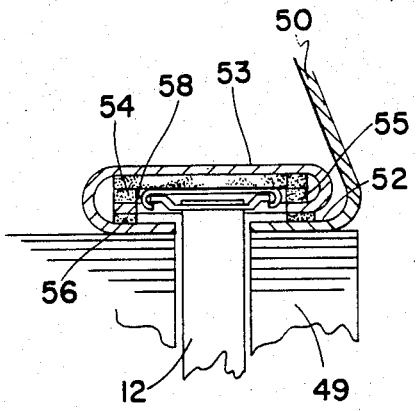
FIG. 5 is a cross-sectional view of the cover and a paper assembled taken across a stack aperture perpendicular to an edge margin as used in the FIG. 4 embodiment.

FIG. 5 illustrates a view of the folded marginal extensions wherein keepers 14 (or prong base 11 - FIG. 1A) is encompassed by the edges of slot 58 in the perforated margin extension 54 and the imperforate margin extension 53 adhered to the keeper top and bent portion of prongs 12.

Figure 6:
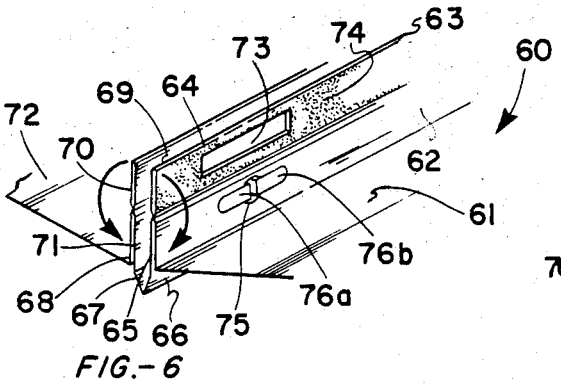
FIG. 6 is a partial schematic perspective view of an integral covers embodiment of the invention showing use (less paper stack) in a Duo-Tang type binding.
Figure 7:
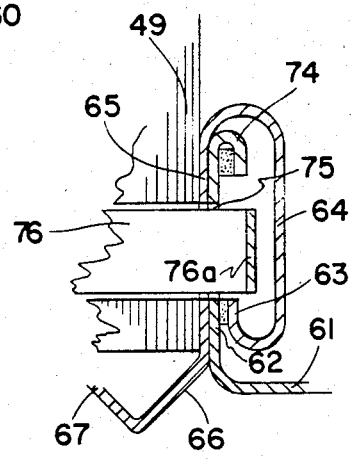
FIG. 7 is a cross-sectional view of an integral cover preferred embodiment and a paper stack as assembled taken across a stack aperture perpendicular to a cover margin edge as used in the FIG. 6 embodiment.

FIG. 6 shows a one-piece dual cover 60 wherein a continuous strip of flexible cover material is folded to form a front cover 61 and a back cover 72 with dual-fold marginal edges 62, 65 and 68, 71, respectively. Initially extending from the marginal edges are margin extensions 63, 64 and 69, 70. Extensions 63 and 70 have a series of slots 73 which when the dual-fold is folded down encompass the bent tangs **76*a*, 76*b* of the Duo-Tang type connector which have passed through circular aperture 75 in the dual-fold margin edges 62, 65 and 68, 71. The overall tang of the connector is crimped into aperture marginal edges 68, 71 in the manner shown by the dotted circle in FIG. 1B. As in the other embodiments a suitable adhesive 74 with peelable release paper is provided on extensions 63 and 70. Score lines may be provided between the respective dual-fold extensions to facilitate folding. Extensions 64 and 69 are imperforate and function to cover the bent tangs 76*a*, 76*b* when folded and adhered thereon. Integral booklet spine sections 66, 67 are provided. Dependent on the thickness of the stack of sheets to be bound together between facing margin edges 65, 68 the angularity of the spine sections will change with the sections being in the same plane when the maximum number of sheets which can be accommodated by the binder are present. FIG. 7 schematically illustrates the folding of the continuous layers 61–67 to encompass, hold and cover the bent prong 76a of dual prong 76 and to bind the paper sheets stack 49**.

Figure 8:
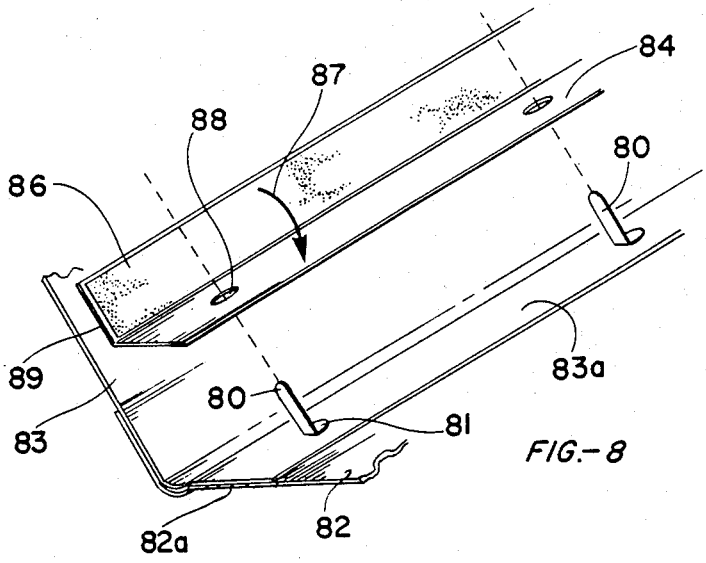
FIG. 8 is an exploded perspective partial view of an additional embodiment of the invention.
Figure 9:
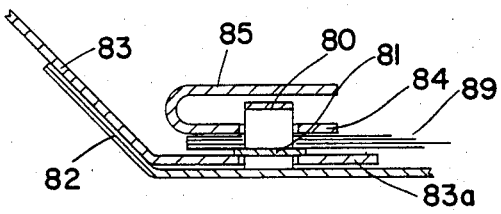
FIG. 9 is an end view of the embodiment of FIG. 8 in paper sheets binding position.

In FIG. 8, another tang-type prior art binding is shown in which tangs 80 have a grommet-like head 81 crimped between an overlapping marginal edge 82a of a first back binder cover 82 and a marginal edge 83a of a second front binder cover 83. In such prior art binding, the tangs which in the as-sold condition are positioned flat against the inner surface of marginal edge 83a of front cover 83 are bent upwardly to receive punched-hole paper sheets and then bent inwardly or outwardly parallel to the marginal edge 83a to bind the paper sheets in the binder. Applicants' invention entails the utilization of a non-integral stiff paper or plastic strip 84 having apertures 88, which apertures are passed over upwardly bent tangs 80 on top of the marginal edge of the paper stack previously placed over and down on the tangs. The tangs 80 are then bent over the strip 84 to clamp the paper sheets between the strip and the overlapping marginal edges of covers 82, 83 and the grommet heads 81. A bendable integral cover strip 85 having an adhesive 86 on its top surface is then folded over the strip 84 and the bent tangs 80 as indicated by arrows 87 to cover the strip 84 and the bent tangs. As in the prior embodiments, release paper is provided on the adhesive layer which paper is removed prior to pressing strip 85 over strip 84 and the bent tangs 80. The resultant binding is seen in more detail in FIG. 9 which shows a few sheets 89 of a paper stack bound between the upper side of the margin at edge 83a of cover 83 and the underside of strip 84 so that the bent tangs 80 and the apertured strip 84 are concealed by the strip 85.

Figure 11:
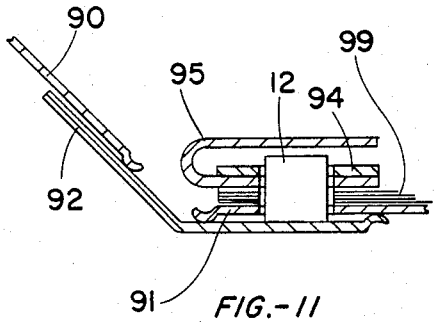
FIG. 11 is an end view of the embodiment of FIG. 10 in paper sheets binding position.
Figure 10:
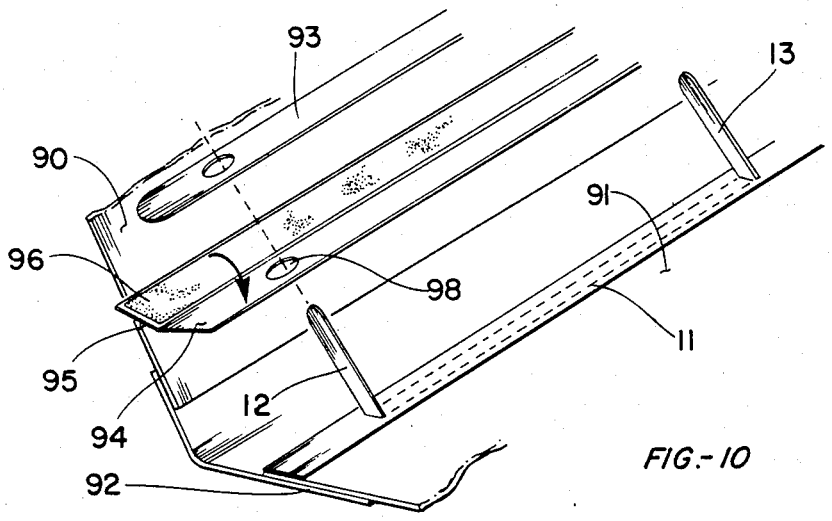
FIG. 10 is an exploded perspective partial view of another embodiment of the invention.

FIG. 10 shows a partial ACCO-type prior art binder modified by Applicants' invention. In the prior art binder, a front cover 90 and a rear cover 91 are attached respectively to the outside and inside of a slit apertured spine strip 92 which also captures the thin metal base 11 of prongs 12, 13 of a prior art ACCO-type connector part an outer marginal surface of the rear cover and an inner surface of the spine margin. In an as-sold condition, a thin flexible plastic strip 93 is positioned over the prongs and the prongs are bent parallel to the spine marginal edge so as to temporarily hold the strip thereagainst. A user bends the prongs perpendicularly to the rear cover margin, removes the plastic strip 93, inserts a punched hole paper sheets stack over the two prongs, places strip 93 over the prongs to a position over the punched hole marginal edges of the paper stack, and then bends the prongs over to complete the binding action. The prongs and apertured strip are exposed. The former can cut a user or scratch a desk surface. Further, the strip 93 has an unsightly bow. Applicants have modified the above construction by utilizing a separate stiff plastic strip 94 having two apertures 98 which strip 94 is inserted on the prongs 12, 13 after the paper sheets stack 99, as seen in FIG. 11, has been placed thereover. Strip 93 is then inserted over strip 94 and the prongs bent over strip 93 to compress and hold the paper sheets margin. A cover strip 95 integral with strip 94 is folded over and adhered to the bent prongs and strips 93 and 94 to effect an aesthetically pleasing binding covering the connector prong and clamping strip portions. Typically, the strip 94 is made of about 1.5 mm thick plastic, leather or paper board. As in the previous embodiment, a paper release sheet is provided over an adhesive layer 96 which is peeled off prior to pressing strip 95 on strip 94

Alternatively, strip 93 may be eliminated entirely and replaced by strips 94 and 95.

The above described constructions result in an imperforate margin extension or layer covering and hiding the otherwise exposed unattractive metal components of the ACCO-type and Duo-Tang or similar-type connectors. It results further in a more secure document which is less likely to be tampered with. At the same time a re-usable pressure-sensitive adhesive may be employed which permits removal of the imperforate (and slotted) extensions so that one or more punched hole sheets may be removed or added to the bound stack. Further the extensions, be they of a single or double thickness (FIGS. 6–7) add stiffness to the binding so there is less bowing of the booklet. This is especially true in the case of ACCO fasteners where only two widely spaced prongs are employed, without any center hole connection in the case of three-hole punched paper sheets.

The above description of embodiments of this invention is intended to be illustrative and not limiting. Other embodiments of this invention will be obvious to those skilled in the art in view of the above disclosure.

We claim:

1. An improved prong/tang-type sheet retainer binding system for binding marginally perforated paper sheets, said binder system comprising a prong/tang-type sheet retainer with a base member and at least two prongs/tangs; at least one marginally apertured paper sheet; at least one cover member with said cover member having a first marginal edge with apertures therein and said prongs/tangs being passed through the apertures in said sheet and then passed through the apertures in said cover marginal edge; the portions of said prongs/tangs extending outwardly from said cover apertures being bent to lie in the plane of said marginal edge to bind the sheet to said cover member; a first imperforate marginal edge extension extending from said marginal edge; adhesive means on one face of said imperforate extension; and wherein said marginal edge extension is foldable to overlie said bent prongs/tangs and said adhesive means can adhere said marginal edge extension against said bent prongs/tangs to cover said bent prongs/tangs and to stiffen said binding system, the improvement comprising:

said at least one cover member, said apertured marginal edge and said marginal edge extension being integral with each other and formed from a continuous integral sheet of bendable cover member material of uniform thickness and wherein said cover member material is foldable at the transition between said cover member and said apertured marginal edge and between said apertured marginal edge and said marginal edge extension;

said binder system further comprising a first slotted marginal edge extension extending from said imperforate marginal edge extension, said second marginal edge extension having at least one elongated generally rectangular slot sized to accommodate said bent prongs/tangs and being foldable against said imperforate marginal edge extension and then being foldable with said imperforate marginal edge extension into the plane of said marginal edge extension to surround said bent prongs/tangs.

2. The binding system of claim 1 in which said slated perforated marginal edge extension has a thickness approximating the thickness of said bent prongs/tangs as said bent prongs/tangs lie on said marginal edge.

3. The binding system of claim 1 including a second apertured marginal edge, a second imperforate edge extension and a second cover member, all integral with said first at least one cover member.

* * * * *